United States Patent [19]

Cribbs

[11] 4,177,773

[45] Dec. 11, 1979

[54] DAMPED AUTOMATIC VARIABLE VALVE TIMING DEVICE FOR INTERNAL COMBUSTION ENGINES

[76] Inventor: John R. Cribbs, 6034 Soledad Mountain Rd., La Jolla, Calif. 92037

[21] Appl. No.: 864,664

[22] Filed: Dec. 27, 1977

[51] Int. Cl.[2] ..... F01L 1/34

[52] U.S. Cl. ..... 123/90.15; 123/90.17; 123/90.31; 123/90.19; 74/568 R; 64/25

[58] Field of Search ..... 123/90.15, 90.19, 90.31, 123/90.17; 64/25; 74/568 R

[56] References Cited

U.S. PATENT DOCUMENTS

| | | | |
|---|---|---|---|
| 2,121,560 | 6/1938 | Duncan | 123/90.15 |
| 2,899,810 | 8/1959 | Pierce | 64/25 |
| 2,977,778 | 4/1961 | Backlund et al. | 64/25 |
| 3,262,435 | 7/1966 | Cribbs | 123/90.15 |
| 3,285,095 | 11/1966 | Rockola | 74/568 R |
| 3,357,358 | 12/1967 | Rateau | 74/568 R |

FOREIGN PATENT DOCUMENTS

| | | | |
|---|---|---|---|
| 1810368 | 6/1970 | Fed. Rep. of Germany | 123/90.15 |

*Primary Examiner*—Charles J. Myhre
*Assistant Examiner*—Jeffrey L. Yates
*Attorney, Agent, or Firm*—Knox & Knox

[57] ABSTRACT

A variable drive means for cam-operated intake and exhaust valves in an internal combustion engine, the variation being responsive to changes in load and rpm of the engine while the engine is running and being completely automatic. The disclosed device provides a slip drive for the camshaft, virtually unaffected by wear and with a predictable, constantly damped biasing action making the device suitable for mass production to suit any engine and preventing vibration and rough operation of the engine and giving automatic wear compensation.

4 Claims, 4 Drawing Figures

DAMPED AUTOMATIC VARIABLE VALVE TIMING DEVICE FOR INTERNAL COMBUSTION ENGINES

BACKGROUND OF THE INVENTION

Compromise camshaft timing has been generally accepted, that is, a positive drive between the crankshaft and the camshaft. However, this has meant considerable sacrifice of performance of internal combustion engines since for low rpm an early intake valve closing is desirable, while at high rpm it is clearly preferable to retard the intake closing point, even to leaving the intake valves open for a short time after the pistons reach the bottom of the intake stroke. This allows the in-rushing air-fuel mixture to literally supercharge the cylinder. At least two proposals have been made for automatically changing the cam timing for high speed operation, namely the 1965 device sold under the mark CAM-A-GO which substitutes an idler gear between camshaft and crankshaft gears and provides for shifting this idler to retard the timing at high speed. The other proposal is disclosed in applicant's earlier patent which discloses a resilient drive coupling between a positively driven sprocket and a plate drivingly connected to the camshaft, said plate being mounted on the sprocket for free rotation, within limits, under the sole discipline of a spring which biases the plate into a position representing an advanced timing position of the camshaft.

SUMMARY OF THE INVENTION

As claimed, the instant invention comprises a damped variable cam timing device incorporated with the camshaft sprocket of an internal combustion engine for automatically retarding the cam timing when the load and engine rpm are increased. The camshaft sprocket is positively driven and is mounted for limited rotative shifting on a face plate carried by the camshaft. A coil spring is effectively interposed between the face plate and sprocket for resilient driving action of the face plate and camshaft. The damping of the limited rotative shift of the face plate and camshaft is accomplished by a Bellville spring-initiated pressure between the face plate and sprocket. One embodiment of the invention for hobbyists particularly has means for adjusting the coil spring and its biasing action, but the hereundisclosed mass production embodiment is designed for a predicted constant functionality.

DETAILED DESCRIPTION OF A PREFERRED EMBODIMENT

Figure 1:
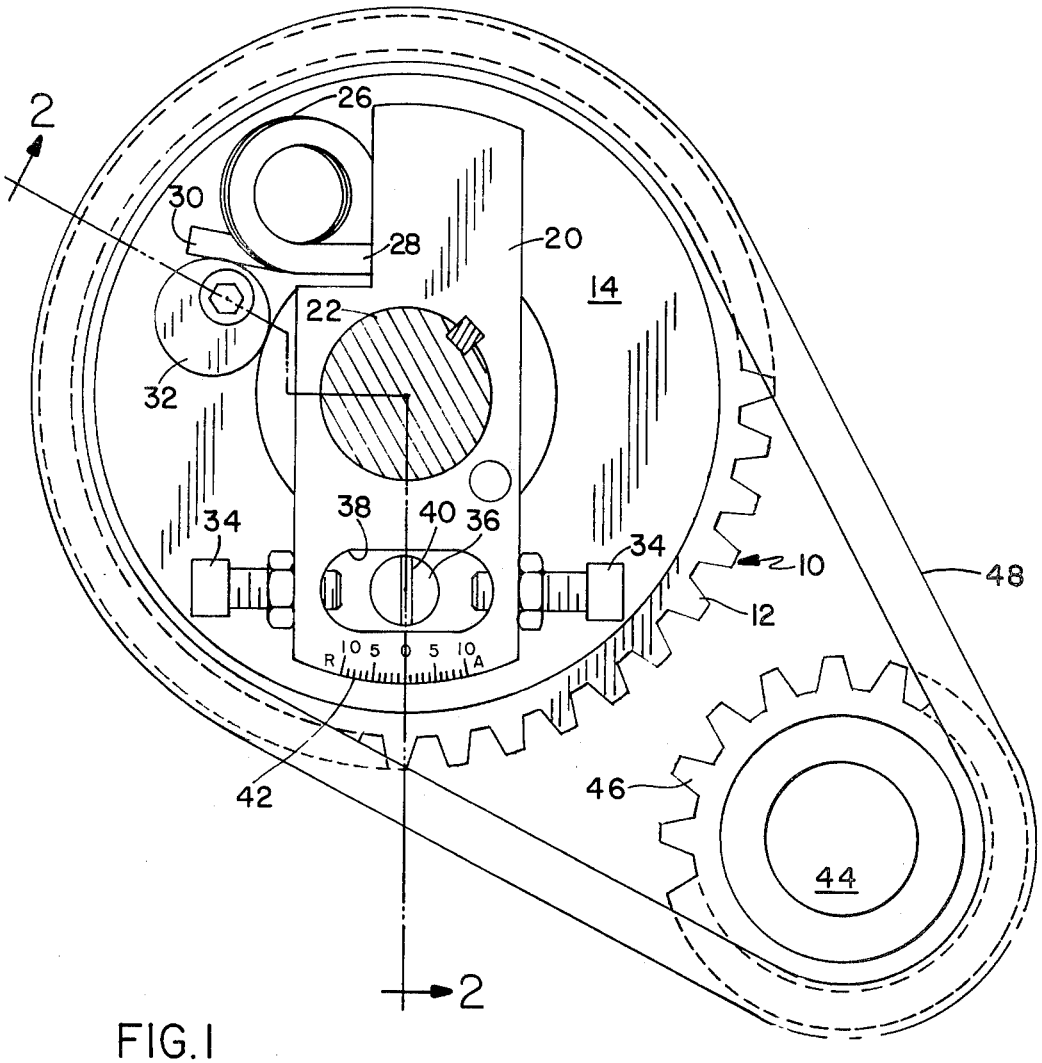
FIG. 1 is a view, largely in plan, of a camshaft driven by a crankshaft and mounted on a face plate according to this invention.

In FIG. 1 the camshaft sprocket assembly, generally indicated by the number 10, comprises a sprocket 12 having a web 14 with an axial hub portion 16. Extending through hub portion 16 is a hub 18 on a face plate 20. This face plate 20 is illustrated as elongated diametrically of the camshaft sprocket 12 and provided with controlled slip means permitting relative rotational movement between the camshaft sprocket assembly 10 and the camshaft 22.

Figure 2:
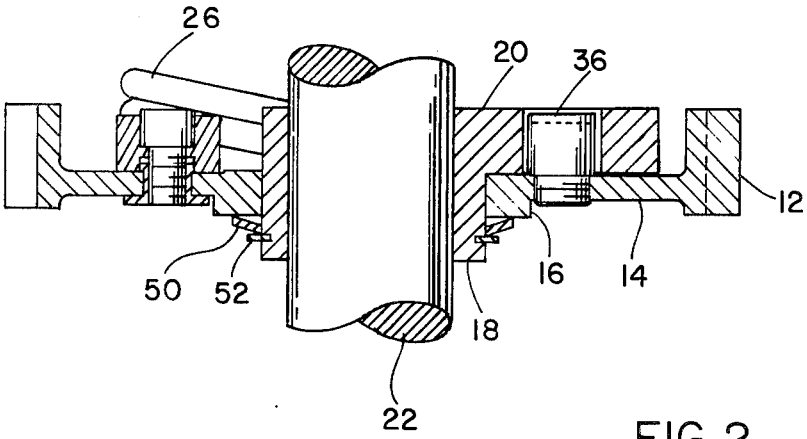
FIG. 2 is a sectional view taken on line 2—2 in FIG. 1.

The controlled slip is accomplished as follows. Face plate 20 is rigidly splined to the camshaft 22 but the face plate 20 can shift relative to the camshaft assembly under the discipline of a coil spring 26. One end portion 28 of the coil spring is firmly captured in the suitably recessed face plate while the other end portion 30 of the coil spring bears against an adjustable stop 32. The stop 32 is essentially an eccentric knob shown as adjustable by a wrench to vary the biasing force of spring 26 against movement of the face plate in one direction relative to the camshaft sprocket assembly. Since the FIG. 1-2 embodiment of the invention is ideal for experimental or hobbyist motor enthusiasts the adjustability is important and the limits of relative movement can be experimentally set by adjustment of opposing machine bolts 34 threaded into the end of face plate 20 remote from the spring 28 so that the inner ends of the bolts selectively abut a stop 36 rigidly screwed to the web 14 within a clearance 38 milled into the face plate 20. The stop 36 may have a screw driver slot 40 to facilitate replacement and an advance-retard scale 42 may be provided on the adjacent end portion of the face plate 20.

The crankshaft 44 with its sprocket 46 drives the sprocket 12 through the timing chain 48. It will now be apparent how the above described resilient drive means permits variation in the working relative positions of the camshaft and crankshaft for the purposes set out above.

A very important feature of this invention resides in the addition of a Bellville spring 50 held by a snap ring 52 on the hub 18 so as to frictionally bear against the end face of the hub portion 16. This Bellville spring traditionally maintains a constant compressive force throughout approximately 80 percent of its compressibility range so that the friction quotient relative to the resilient drive means remains virtually constant, thus making accurate adjustment of the spring 26 predictable and reliable. In other words, the Bellville spring 50 insures against wear introducing any appreciable error or change in the proportioning of engine speed and valve timing. The damping action of this spring and its importance in relation to assembly line production is discussed hereinafter.

Figure 3:
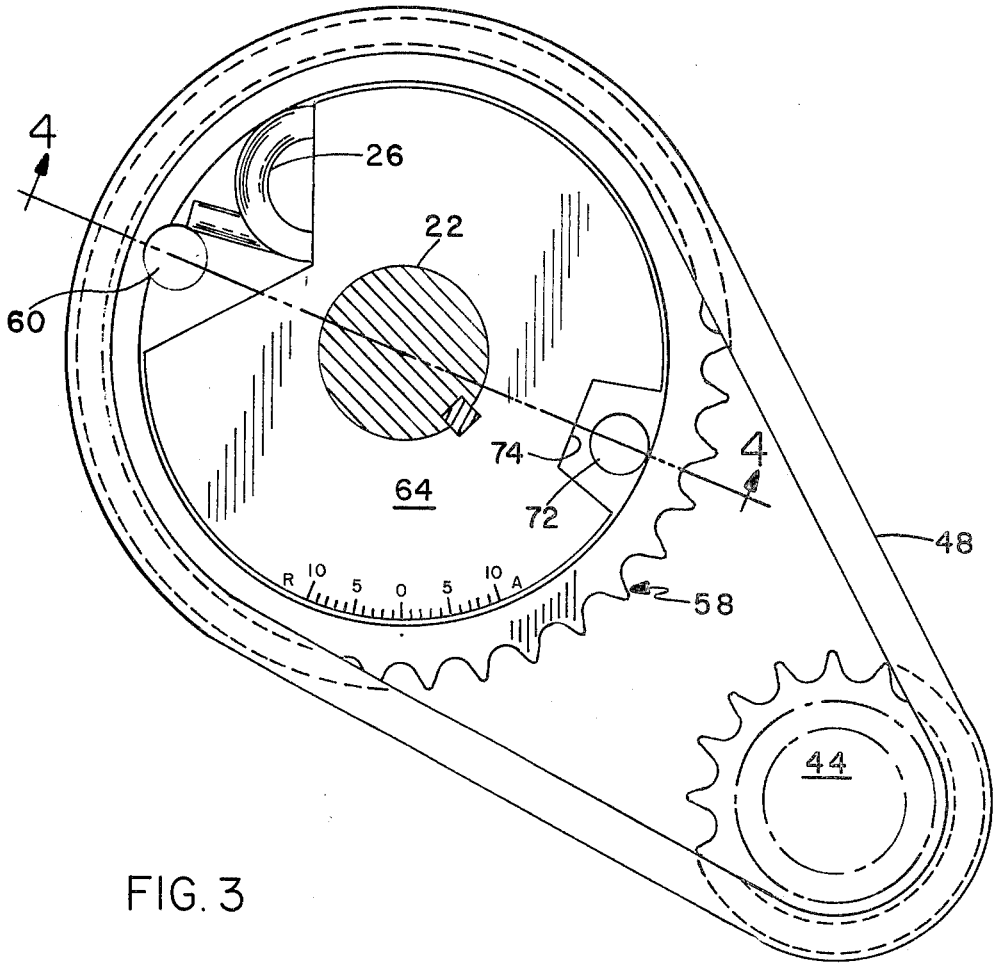
FIG. 3 is a view similar to FIG. 1 but showing an embodiment of the invention adapted for mass production.
Figure 4:
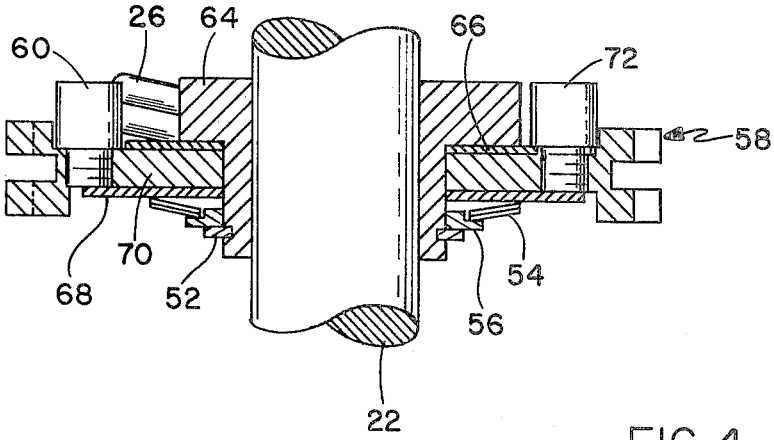
FIG. 4 is a sectional view taken on line 4—4 of FIG. 3.

The same invention finds expression in the embodiment illustrated in FIGS. 3 and 4, this form being particularly suited for use in four, five or six cylinder motors where power impulses are reduced in frequency but increased proportionately in strength. A double Bellville spring 54 is held in place by a stepped collar 56 and a snap ring 52. The camshaft sprocket assembly 58 is virtually unchanged from that already described and is provided with a spring stop 60 for non-varying engagement with spring 26. The face plate indicated by the numeral 64 is more nearly annular to provide a greater frictional area, corresponding with the doubled Bellville spring 54, and anti-galling washers 66 and 68 are provided on the top and bottom wear surfaces of said web 70, that is, between the web 70 of the camshaft sprocket and the face plate 64 and between the web 70 and Bellville spring 54, respectively. A limit stop 72 is fixedly secured to the web 70 within a clearance 74 in the face plate 64. This simplified form of the invention is adapted for large production manufacture where adjustment by the user or maintenance service is not anticipated, the settings being accomplished more or less permanently at the factory.

It will now be evident that the resilient drive means of this disclosure will automatically provide retardation in valve timing proportional to increased torque and rpm. This greater torque is prolonged during high speed operation due to the fact that the exhaust valves must open against combustion pressure, and the resilient drive means continues to reflect this prolonged high torque. As mentioned above the Bellville spring, either single or double as indicated at 50 and 54, has an importance which may not be immediately recognized. The use of these springs virtually neutralizes the result of wear so that adjustment or maintenance after installment is not required, making the device suitable for assembly line production. Of course this mass production capability also reflects the employment of the standardized coil spring 26. The specifications will vary for different engines for various reasons, one important consideration being the number of cylinders. For example, a four cylinder motor will have fewer but stronger power impulses for a given output and so the double spring 54 is required, along with the greater frictional contact area provided by the face plate 64, to smooth out or flatten the response transmitted to the camshaft under conditions of increased load and rpm to prevent excessive wear, vibration and rough operation. Reference is made to SAE No. 741046, Measurement of Automotive Timing Chain Drive Loads, by S. A. Avramidis, "cylinder firing superimposes a cyclic load to this almost steady load (valve springs etc.) The resultant load generally increases with engine speed and is somewhat sensitive to engine load". The cyclic load is largely due to overcoming the so-called "gas load" operative against exhaust valves opening and it is this cyclic load that the Bellville spring means must cope, to smooth the operation and thus prevent vibration, particularly excitation of the coil spring to vibrate at its natural frequency. The device is also substantially self-compensating for temperature changes, since an increase in temperature tends to expand the metal parts to increase pressure between the parts compressed by the spring means 50 and 54 but the same temperature rise tends to lessen the inherent compressive action of the spring means so that there is temperature self-compensation.

Having described my invention, what I claim as new is:

1. An automatic variable cam drive for internal combustion engines having a crankshaft and a camshaft, said cam drive comprising:

a face plate fixed to a camshaft;

a sprocket mounted for limited rotation on said face plate axially of said camshaft and positively driven in one direction by a crankshaft;

a resilient drive coupling operatively mounted on and between said face plate and sprocket and producing a bias in said face plate and camshaft to turn with said sprocket in said direction, whereby gas load reaction to high crankshaft rpm overcomes said bias and said face plate and camshaft have a relative shifting movement to a rotationally retarded position to give a like retarded valve timing; and spring means operatively positioned between said face plate and the positively driven sprocket to dampen and smooth out said shifting movement.

2. Apparatus according to claim 1 wherein said spring means includes a Bellville spring effectively pressing said face plate against said sprocket.

3. Apparatus according to claim 1 wherein said resilient drive includes a coil spring having one end captured in said face plate and the other end engaged with a stop on said sprocket;

a second stop on said sprocket; and stop-engaging means on said face plate to engage said second stop and being capable of measured adjustment for variably limiting said relative shifting movement.

4. Apparatus according to claim 2 wherein anti-galling washers are inserted on the wear surfaces of the web of said sprocket enabling said Bellville spring to exert strong axial thrust without galling.

* * * * *